US005337433A

United States Patent [19]

Gould et al.

[11] Patent Number: 5,337,433

[45] Date of Patent: Aug. 16, 1994

[54] POOL CLEANER

[75] Inventors: Robert F. Gould, San Francisco; Merritt A. Robinson, San Anselmo, both of Calif.

[73] Assignee: Jandy Industries, Novato, Calif.

[21] Appl. No.: 18,980

[22] Filed: Feb. 18, 1993

[51] Int. Cl.[5] ..... E04H 3/20

[52] U.S. Cl. ..... 15/1.7; 15/404; 137/624.14

[58] Field of Search ..... 15/1.7, 404, 416, 419, 15/420, 421; 137/493, 624.14

[56] References Cited

U.S. PATENT DOCUMENTS

| | | | |
|---|---|---|---|
| 4,023,227 | 5/1977 | Chauvier | 15/1.7 |
| 4,133,068 | 1/1979 | Hofmann | 15/1.7 |
| 4,208,752 | 6/1980 | Hofmann | 15/1.7 |
| 4,351,077 | 9/1982 | Hofmann | 15/1.7 |
| 4,378,254 | 3/1983 | Chauvier | 134/21 |
| 4,642,833 | 2/1987 | Stolz et al. | 15/1.7 |
| 4,742,593 | 5/1988 | Kallenbach | 15/1.7 |
| 4,769,867 | 9/1988 | Stolz | 15/1.7 |

FOREIGN PATENT DOCUMENTS 866702 9/0198 South Africa .

*Primary Examiner*—Timothy F. Simone
*Assistant Examiner*—Patrick F. Brinson
*Attorney, Agent, or Firm*—Corwin R. Horton

[57] ABSTRACT

A pool sweep having a continuously-cycling, flow-interrupting valve at the upstream entrance to an inertial flow chamber. The valve has an entrance mouth with one or more closure lips pivoting been open and closed positions to open and close the mouth. The lips are biased towards closure with low creep biasing means, as by materials having a strain at its elastic limit of below 0.5 such as one or more metal springs urging the lip toward closure. The magnitude of the opening bias throughout the range of movement of the lips between open and close under dynamic flow conditions is substantially less than the closing force created by the water flow through the valve mouth urging the lips towards closure and substantially greater than the closing force imparted by flow through the mouth during lip travel from full closure to the open position. Over an initial closure-initiating region beginning from the fully open position the opening bias is substantially less than the closing force on the lips created by the water flow through the valve mouth under steady flow conditions, such as occur at start-up. Desirably, the opening bias is substantially less than the closing force on the lips created by the water flow under steady flow conditions as well over an opening-initiating region towards the open position beginning from the full closure and in the region intermediate these two end regions.

29 Claims, 7 Drawing Sheets

POOL CLEANER

BACKGROUND OF THE INVENTION

This invention relates to swimming pool cleaning devices that operate automatically to move over the surface to be cleaned when water is induced to flow through the device by the suction created by conventional swimming pool filtration equipment. In these devices water flow in a flow passage through the device is intermittently interrupted by a valve mechanism in the passage with the result that the device moves stepwise in random fashion over the pool surfaces. This allows the surfaces to be cleaned by water flowing over such surfaces into and through the device to the filter unit.

Among the various valving arrangements that have been proposed for such cleaning devices U.S. Pat. No. 4,769,867 describes a valve in the form of a pair of "jaw-like" members biased to an open position by the inherent elasticity of the plastic material forming a portion or all of the valve. The mode of operation is as follows. When suction is applied to the flow passage water flows through the passage and this reduces the pressure at the internal surfaces of the valve. When the flow velocity reaches a critical value, the valve closes due to the differentially higher pressure on the external surfaces of the valve which overcomes the biasing force maintaining the "jaws" at the open position.

While the described valve could have potential advantages of simplicity, relatively compact size and reduced susceptibility to plugging by debris, it has inherent limitations which render it unsatisfactory as it is incapable of achieving the sustained operation required for typical applications in which the cleaner is operated on a daily cycle, usually for daily periods of up to 18 hours or higher. Over a period of a year of such sustained operation may require up to fifty million or more beats or cycles of the valve.

Specifically, it has been found that in operation over time elastomeric material employed to bias the valve to the open position is inherently subject to creep and gradually looses its "memory" such that the "jaws" do not return completely to the open position. As this memory loss or creep progresses the valve begins to cycle more rapidly, with consequent undesirable loss of flow rate, and finally the valve ceases to function entirely.

The memory loss defect has been partially overcome by application of an auxiliary, low creep biasing means to maintain the valve open during periods of non-use, thus permitting at least partial restoration of the memory of the elastomeric material. Nevertheless, over time, permanent deformation will still take place which increases maintenance requirements eventually requires replacement of the valve.

Equally important, construction of a valve of the described empirical design that will actually operate, much less operate reliably under field conditions, is, at best, a haphazard proposition.

Additionally, the "jaw-type" valves described are susceptible to fouling by debris becoming caught at the corners (side margins) of the mouth opening. When the jaws attempt to close on the debris at the corners, they are held at a partially open position and are then unable to either reopen or close completely. Consequently, the cleaner will cease to function until it is shut off, the debris removed and then restarted.

SUMMARY OF THE INVENTION

The invention relates to an automatic pool sweep having an intermittently interrupted flow system which is capable of extended, reliable use and particularly without deterioration of the cycling characteristics and capability of the flow-interrupting valve. The system employs an inertial flow chamber having which is closed off by a valve that in operation continuously cycles between the open and closed positions. The valve has an entrance mouth with one or more closure lips pivoting between open and closed positions to open and close the mouth. The lips are biased towards the open position in accordance with this invention with low creep biasing means, thus permitting extended usage without degraded performance. Desirably, the biasing means comprises one or more metal springs directly or indirectly urging the lip toward the open position, as by acting on a lever arm connected to the lip at a pivot point. In accordance with this invention the magnitude of the opening bias throughout the range of movement of the lips between open and close under dynamic flow conditions following start-up is substantially less than the closing force created by the water flow through the valve mouth urging the lips towards closure and substantially greater than the closing force imparted by flow through the mouth during lip travel from full closure to the open position. Additionally, over an initial closure-initiating region beginning from the fully open position the opening bias is substantially less than the closing force on the lips created by the water flow through the valve mouth under steady flow conditions, such as occur at start-up. Desirably, the opening bias is substantially greater than the closing force on the lips created by the water flow under steady flow conditions as well over an opening-initiating region towards the open position beginning from the full closure and in the region intermediate these two end regions. For the bias low creep elastic materials are utilized, preferably metal such as spring steel, and typically materials with a strain at their elastic limit (increase in length over original length in the relaxed state) of below 0.5. Elastic materials with a strain at the elastic limit of less than 0.2 are desirable and those below 0.1 are preferred.

The inertial flow chamber of the flow system cooperates with the valve in creating the dynamic flow forces that produces sustained cycling of the valve constructed and biased in accordance with this invention. Desirably the inertial chamber is at least 10 centimeters in length and the diameter at least 1 centimeter and a length of at least 20 cm and a diameter of at least 1.5 cm is preferred.

Figure 2:
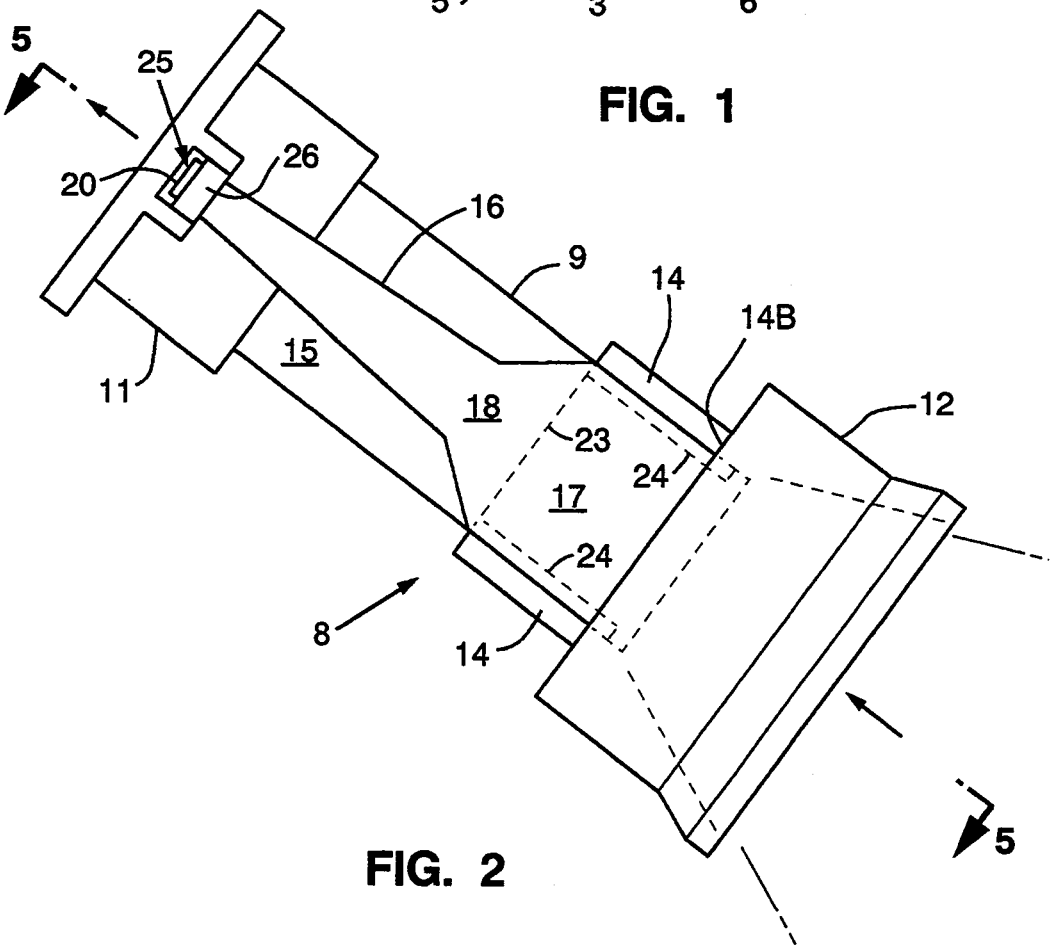
FIG. 2 is a plan view in enlarged scale of an embodiment of a valve in accordance with this invention for the pool cleaner of FIG. 1.
Figure 3:
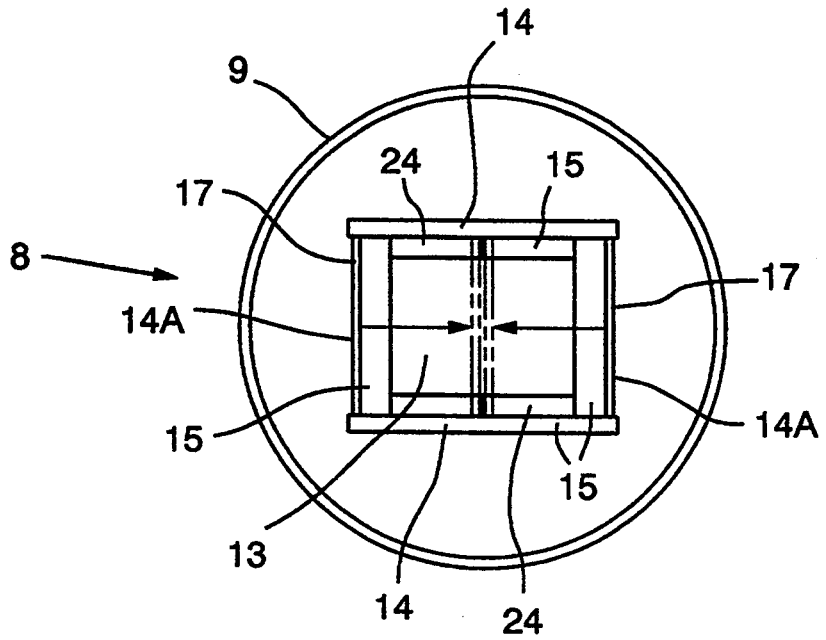
FIG. 3 is an end view of the valve of FIG. 2 taken at the upstream end, as indicated by the flow direction arrows, showing the mouth of the valve in the open position and, in phantom view, in the closed position.
Figure 4:
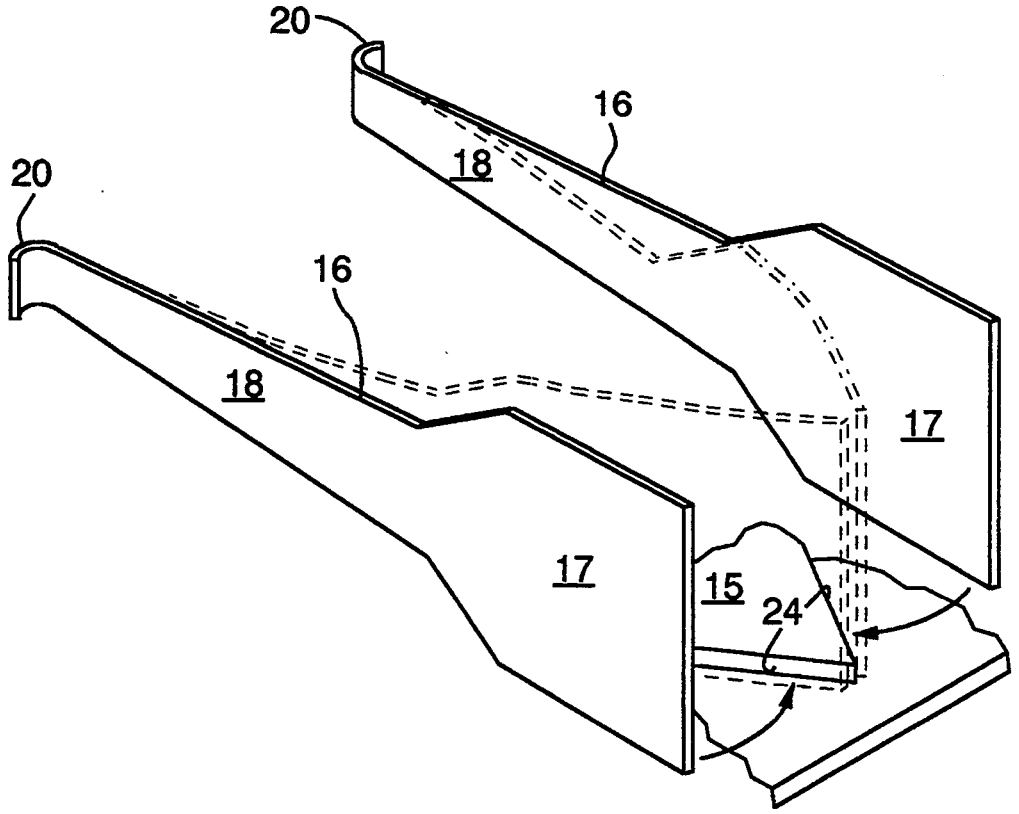
FIG. 4 is a fragmentary isometric view of the valve closures and wall mouth of the valve of FIGS. 2 and 3 showing the valve closures in the open position and, in phantom view, in the closed position.
Figure 5:
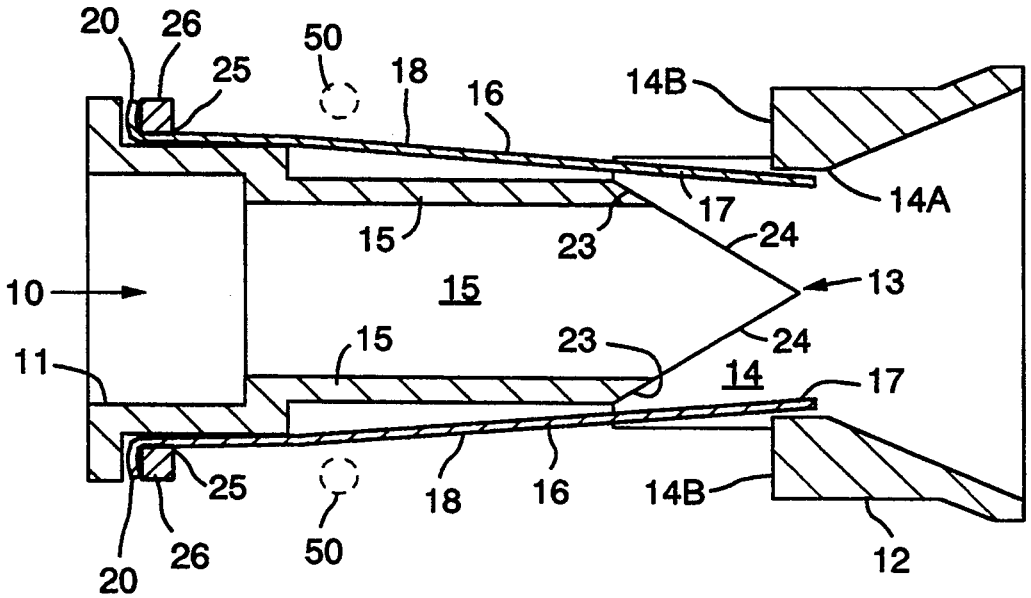
Figure 6:
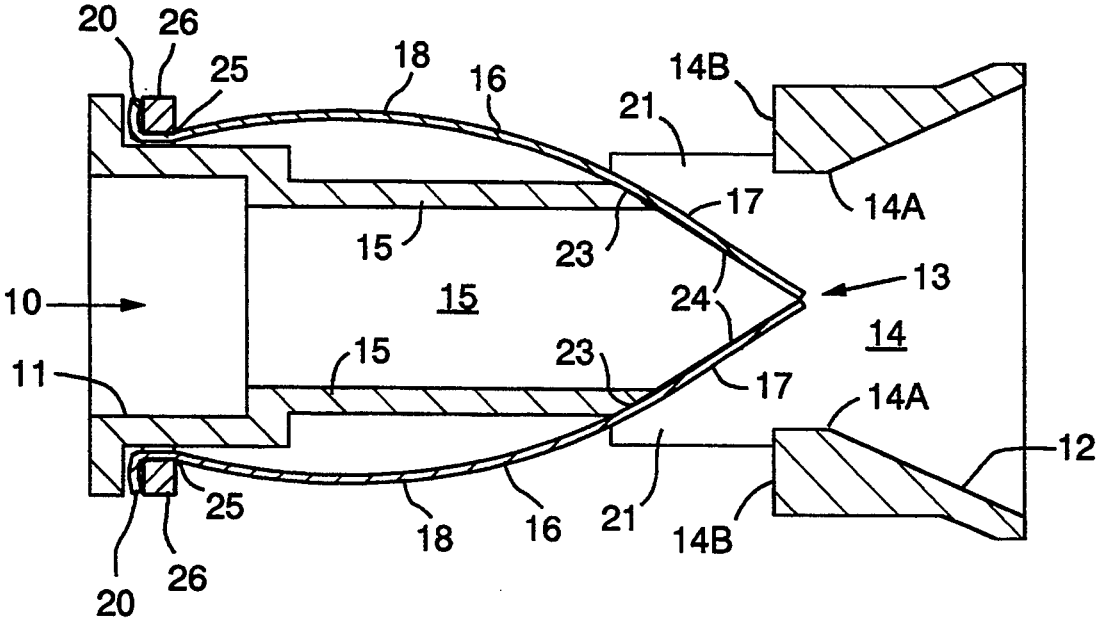
Figure 8:
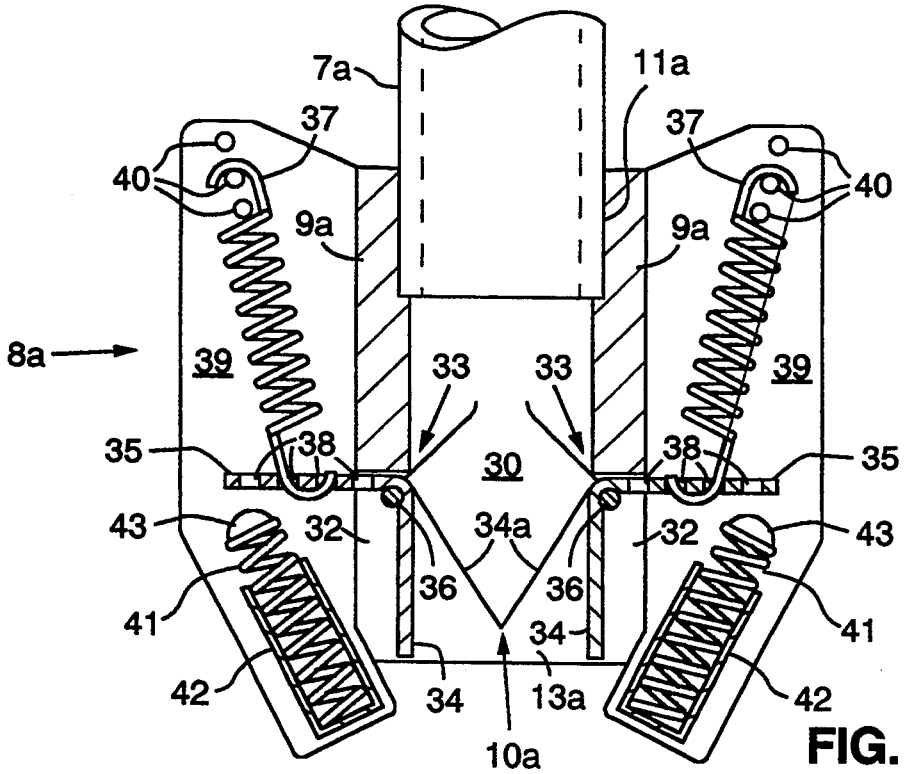
Figure 7:
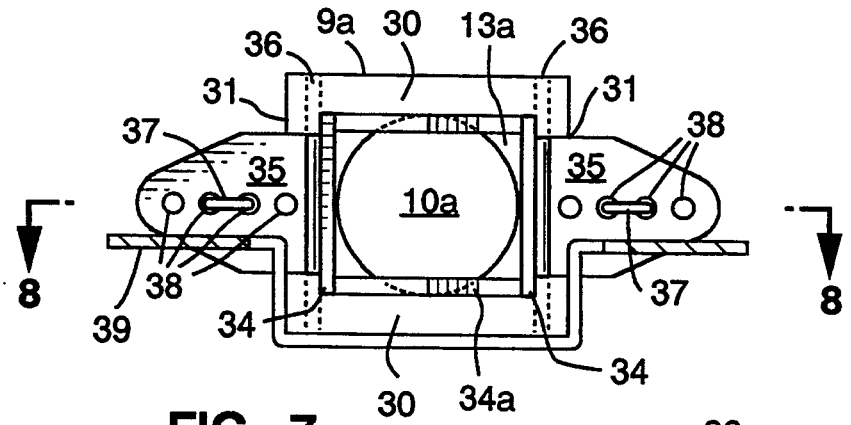
Figure 9:
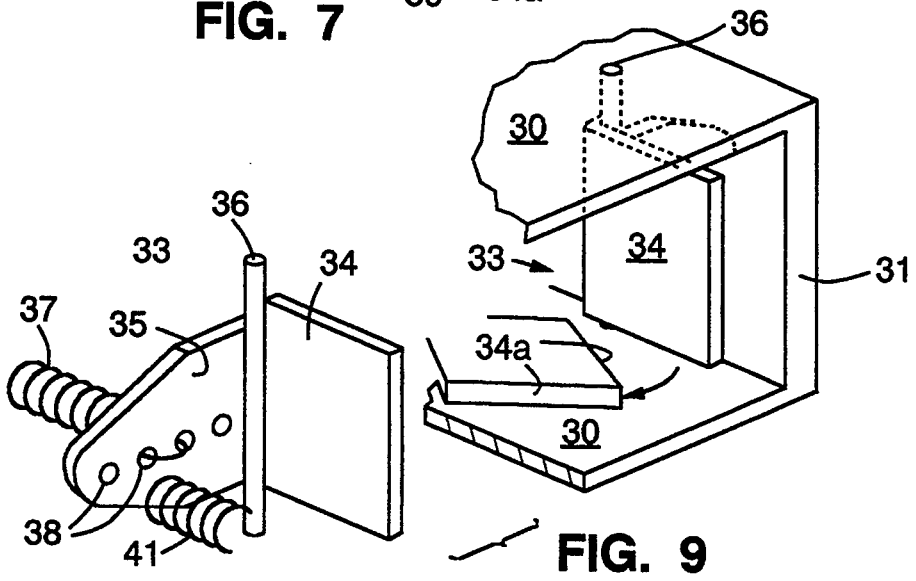
Figure 10:
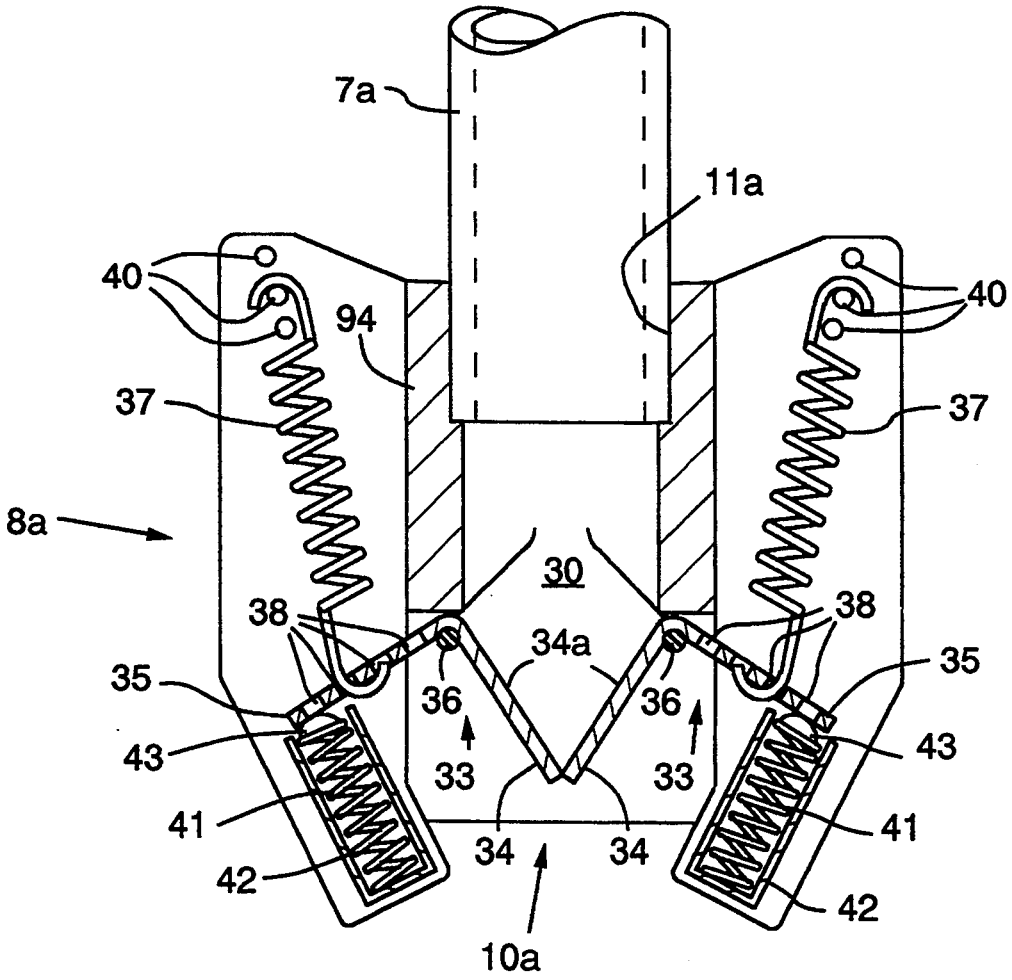
Figure 11:
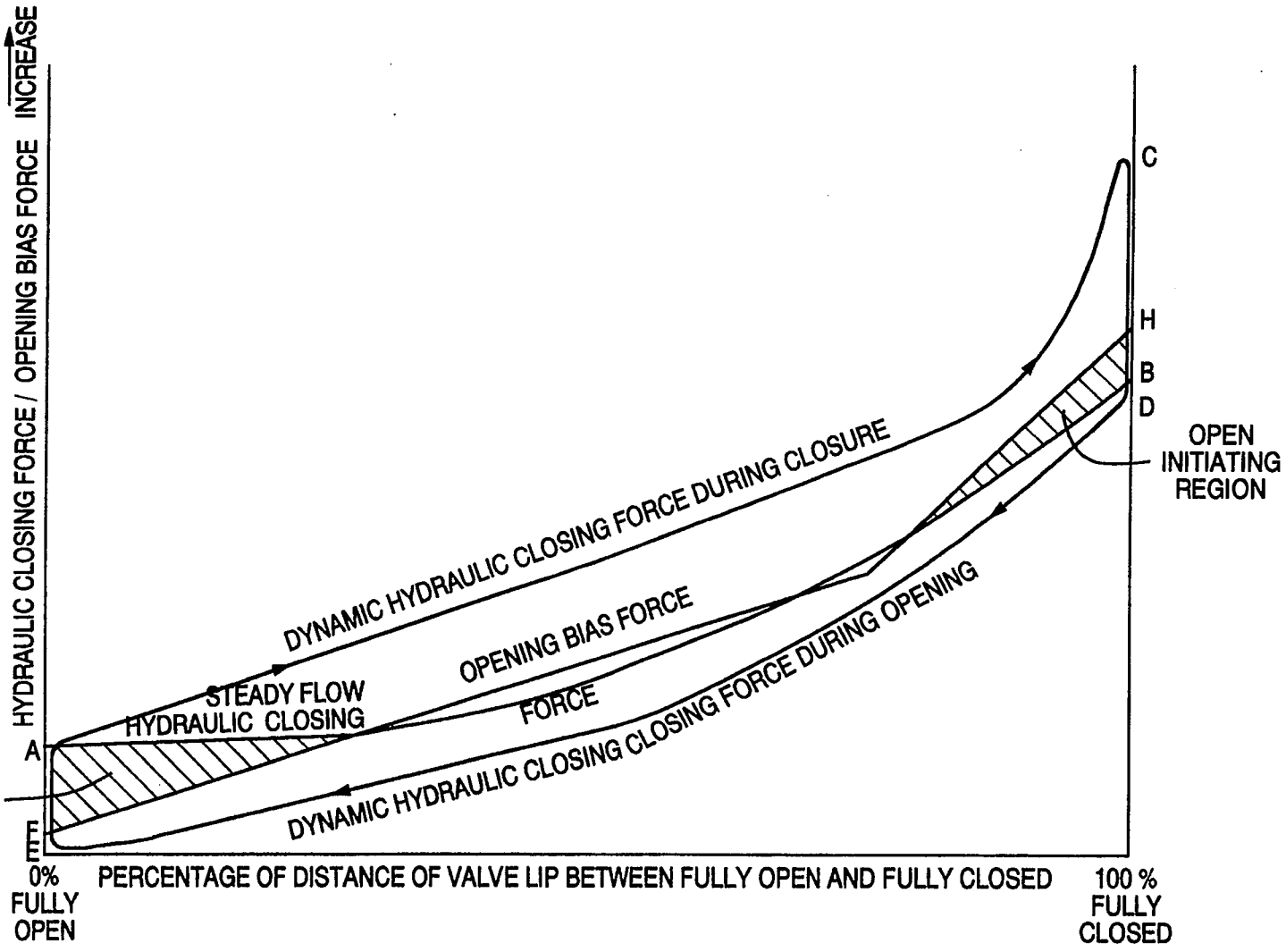

FIG. 5 is a cross-sectional view of the valve of FIGS. 2-4 taken along line 5—5 in FIG. 2, showing the valve closures in the open position;

FIG. 6 is the same cross-sectional view of the valve of FIGS. 2-4 of FIG. 5, but showing the valve closures in the closed position;

FIG. 7 is an end view, taken at the upstream open end, of another embodiment of a valve in accordance with this invention;

FIG. 8 is a cross-sectional view of the valve in of FIG. 7, taken along lines 8—8;

FIG. 9 is an fragmentary, exploded isometric view of the mouth and closures therefor of the valve shown in FIGS. 7 and 8;

FIG. 10 is same cross-sectional view as FIG. 8 but with the valve closures pivoted to the closed position;

FIG. 11 is a representative graphical plot of the magnitude of the forces on a lip of a closure of the valve of FIGS. 7-10 tending to open and to close it, throughout the range of positions of the lip from full open to full closure.

Figure 12:
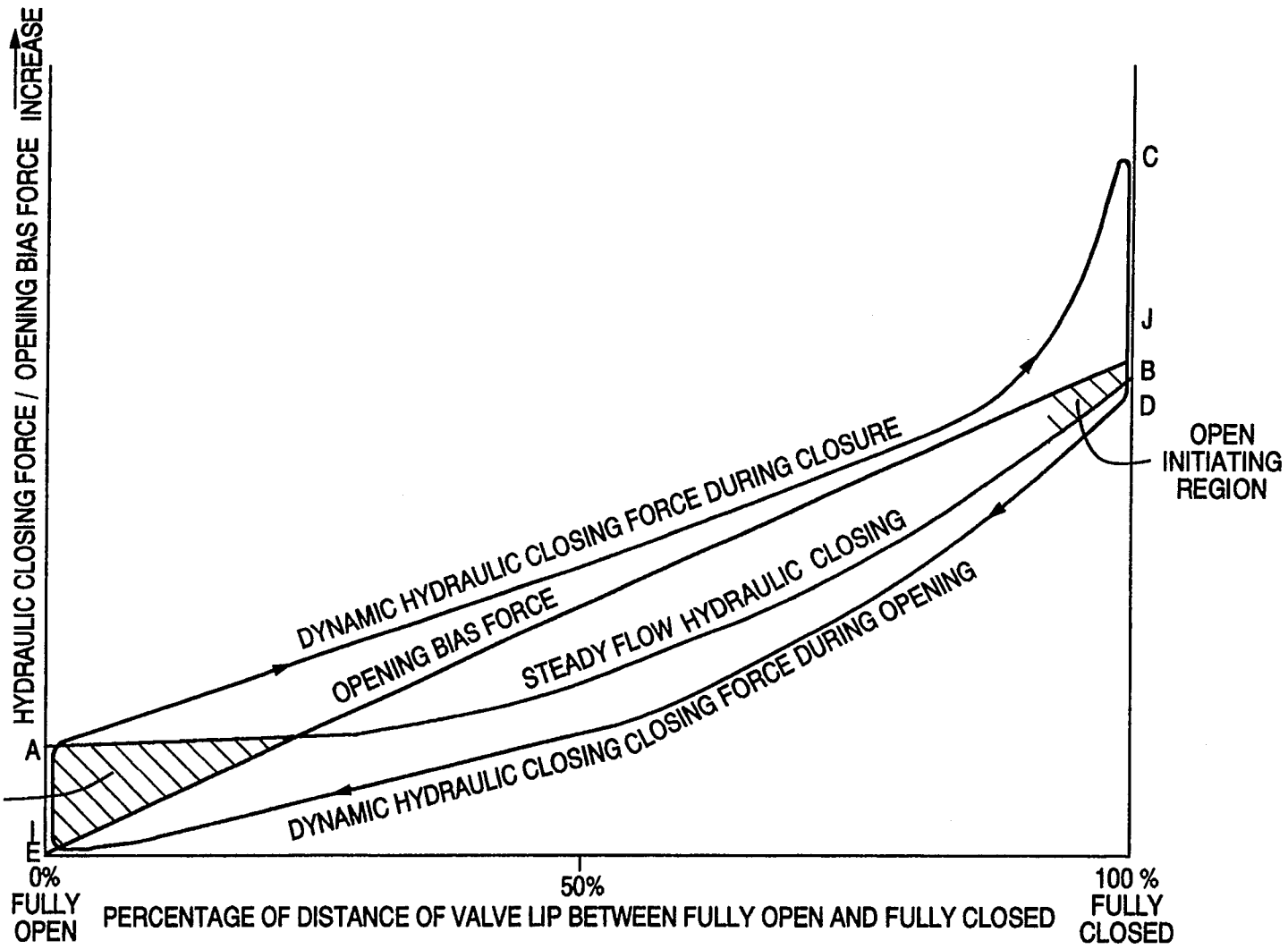

FIG. 12 is a representative graphical plot of the magnitude of the forces on a lip of a closure of the valve of FIGS. 2-6 tending to open and to close it, throughout the range of positions of the lip from full open to full closure.

DETAILED DESCRIPTION OF THE PREFERRED EMBODIMENT

The following description illustrates the manner in which the principles of the invention are applied but is not to be construed as limiting the scope of the invention.

Figure 1:
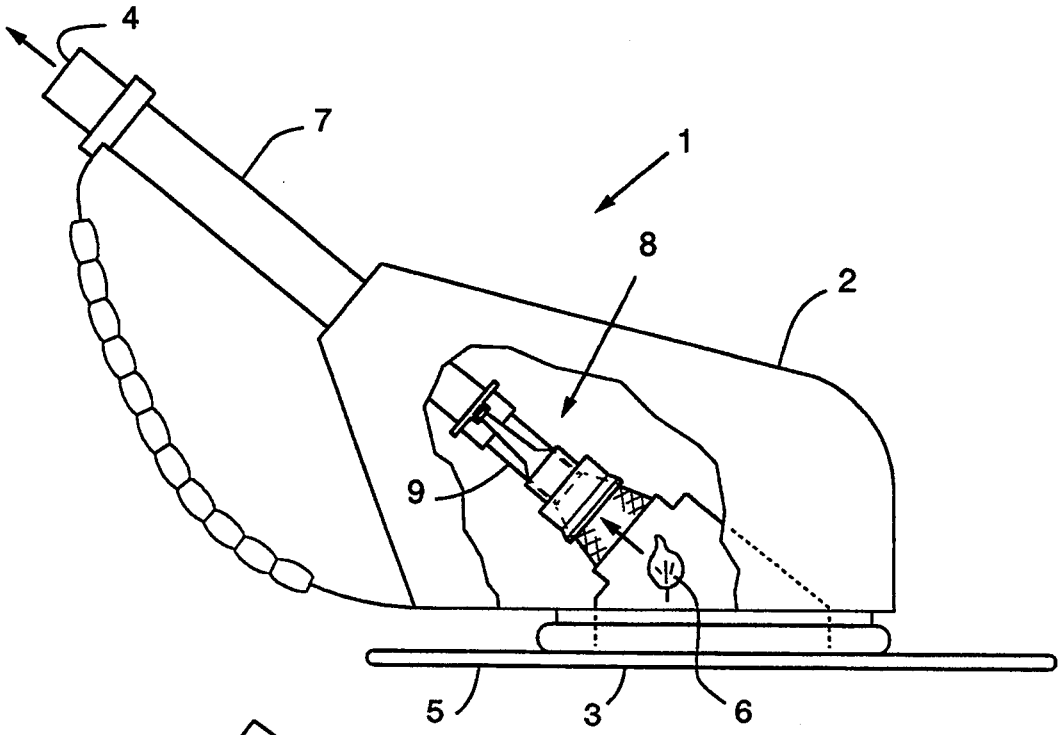
FIG. 1 is a partially sectional elevation view of a swimming pool cleaner of the present invention.

Referring to FIG. 1 of the drawings, reference numeral 1 generally indicates a swimming pool cleaner comprising a head 2 having an inlet 3 and an outlet 4. A flexible circular surface-engaging disc 5 surrounds the inlet 3. The flow passage between the inlet 3 and the outlet 4 includes an inlet chamber 6 immediately upstream of inlet 3 and chamber 7, which is in the form of a tubular section having rigid walls, upstream of inlet chamber 6. A valve 8 is located in the flow passage at the upstream end of chamber 7. At its upstream end valve 8 communicates directly with inlet chamber 6.

As best seen in FIGS. 2-6, valve 8 has a valve body 9 with a flow passage 10 therethrough. At the downstream end of flow passage 10 valve body 9 is in the form of a socket 11 of circular configuration that receives the upstream end of chamber 7 so as to connect in flow communication therewith. At the upstream end of valve body 9 passage 10 opens to inlet chamber 6. At its opening to inlet chamber 6 passage 10 is a funnel section 12 narrowing in the downstream direction to confront a valve mouth 13 of rectangular cross-section defined by a pair of walls 14 and a second pair of opposed walls 14A. Immediately downstream of mouth 13 valve body 9 steps to a slightly smaller rectangular cross-section defined by walls 15 extending to socket 11. Opposed walls 14A each terminate in the downstream direction at a respective sidewall 14B which is a distance upstream of the step at wall 15 to leave a rectangular opening 21 therebetween.

A pair of closures 16 mounted on opposed sides of mouth 13 consist of elastic but relatively rigid material, such as 0.015 inch in thickness stainless steel leaf spring material. A relatively wider upstream portion of each closure 16 constitutes a lip 17 connecting with a narrower downstream portion which constitutes shank 18. Shank 18 has rapidly narrowing shoulders portion 19 and a longer downstream portion that gradually narrows yet more to an upwardly curved end section 20 at its downstream end, all for purposes to be explained.

Lip 17 of each closure extends upstream across and covering a respective opening 21 with its upstream end portion extending under and along a respectived wall 14A. The downstream end of lip 17 overlies the upstream edge 23 of wall 15 and edge 23 serves as a pivot around which lip 17 rotates as it moves inwardly to a closed position from its open position parallel with wall 14A. Pivot edge 23 is beveled to slope inwardly of valve body 9 at an angle that matches that of lip 17 when in the closed position so that lip 17 lies flat against the bevel when closed. As best seen in FIGS. 4 to 6, walls 15 to either side of lips 17 extend upstream beyond pivot edges 23 of the adjacent walls 15 to terminating edges 24 that lie along the location of the side margins of lips 17 when they are in their closed positions to thereby serve as both inward stops and side seals. Preferably, a slight gap is left between the side margins of lips 17 and adjacent walls 14 to insure clearance and minimize the possibility for debris to become wedged therebetween stopping free movement.

Shank 18 of each closure 16 extends downstream of pivot edge 23 along adjacent wall 15 to the outside of valve body 9 and is slidably engaged at its downstream end through a slot 25 formed between wall 15 and detent 26 formed on valve body 9. Slot 25 extends first in the downstream direction and then outwardly of valve body 9 to accommodate curved end section 20 of shank 18, thereby to restrain the downstream end of shank 18 from movement both outward of valve body 9 and in either direction parallel with the main axis of valve body 9. However, as shown in FIGS. 5 and 6, end section 20 is free to rotate around detent 26 for a short distance as shank 18 bows outward when lip 17 moves inward toward the closed position around edge 23, thus accommodating the flexing action of closure 16.

Inward force on lips 17 cause closures 16 to flex about pivot edges 23 to bring the upstream edge of lips together to close off mouth 13. As they are relatively wide, lips 17 remain substantially straight as they pivot to closure. However, the inward movement of lips 17 will cause narrower shanks 18 to flex outwardly and generate an opposing force urging lips 17 outwardly, thereby providing a bias to the full open position generally parallel to the flow direction through valve 9. Shanks 16 will be selected and configured to provide biasing force over the range of movement of lips 17 between the open and closed positions in accordance with this invention as will be explained.

In use, outlet 4 is connected to a flexible suction hose (not shown) which in turn is connected to the suction intake of a swimming pool filtration pump. When suction is applied to outlet 4, water flows through inlet 3 to inlet chamber 6. From there the water flows into and through valve 8, then in the open position, to and through chamber 7 to outlet 4. The water flow creates a differentially lower pressure on the interior surfaces of lips 17 compared to the pressure at the exterior surfaces. And when a critical flow velocity is reached, that differential becomes sufficient to overcome the opening bias force on lips 17 and the lips close to stop the water flow. This closure is rapid and due to the inertia of the water flow a "water hammer" effect is created in chamber 7 that momentarily decreases the pressure at the interior surfaces of lips 17 and this is followed rapidly by an increase in interior pressure due to the inertia of the water in the tube, now which has now decelerated to a velocity that is substantially lower or entirely to a motionless state. The interior and exterior pressure on lips 17 is thus at least partially equalized and consequently after a brief period the biasing force on lips 17 forces them again to the open position. Upon return of valve 8 to the open position the cycle is repeated resulting in the intermittent opening and closing of valve 8. The intermittent flow interruption causes the cleaner to move step-wise along the pool surfaces to clean them.

An alternative valve design is shown in FIGS. 7–10. Valve 8*a* has a valve body 9*a* with a flow passage 10*a* therethrough which is circular in cross section at its downstream end 11*a* where the valve is connected in flow communication to a downstream chamber 7*a*. At the upstream end of valve body 9*a* passage 10*a* opens to an inlet chamber similarly to the first embodiment.

Valve mouth 13*a* of rectangular cross-section is defined by a first pair of opposed walls 30 and a second pair of opposed walls 31. Walls 31 each have a rectangular opening 32 to accommodate a pivotable closure 33. Pivotable closures 33 each comprise a lip 34 and a lever arm 35 and each is pivotably mounted about an axis formed by pin 36 to pivot from an open position at which they are spaced apart and parallel to the flow direction through mouth 13*a* to a closed position to progressively close off flow chamber 13*a*, with the upstream edges of lips 34 finally meeting at the middle of mouth 13*a* to completely close it off. Walls 30 serve as side seals or dams for lips 34 and each has an interior ledge 34*a* that extends along the margins of each of lips 34 when they are fully pivoted inward to the closed position to seal off the edges of lips 34 when they are in the fully closed position.

Lever arm 35 of each closure 33 is engaged by the upstream end of a tension spring 37 at one of a series of anchor holes 38 along the length of lever arm 35. The downstream end of tension spring 37 engages platform 39 at one of a series of alternative anchor pins 40 along the flow direction on platform 39. Platform 39 is, in turn, fixed to valve body 9*a*. Each spring 37 provides a primary force biasing its respective closure lip to the open position. Springs 37 are conventional coil springs composed of steel spring wire which are essentially linear in force, i.e. they provide a linearly biasing force throughout the travel distance of the closures from fully open to fully closed. The alternative anchor pins 40 on platform 39 for the downstream end of tension spring 37 are spaced along the flow direction to permit easy adjustment of amount of tension force applied to lever arm 35.

A compression spring 41 is positioned on platform 39 upstream of each lever arm 35 and in its path of travel as the closure moves toward the closed position. Each compression spring 41 has a casing 42 which is secured to platform 39. Spring 41 is partially nested in its casing 42 for compressive movement in the upstream direction and expansive movement in the downstream direction when head 43 of spring 41 engages lever arm 35. Thus when closure 33 moves toward the closed position lever arm 35 pivots into engagement with the head 43 of compression spring 41, compression spring 41 compresses and applies a secondary force on lever arm 35, beginning from the point of engagement, biasing the lever arm towards the open position. Compression spring 41, as positioned, is compressible throughout the range of movement of the lever arm from the point of its engagement therewith to the position of the lever arm at full closure of closure 33.

Compression spring 41 is desirably mounted for adjustment relative to path of lever arm 35 to vary the radial position therealong at which head 43 engages it. This permits easy adjustment of the magnitude of supplemental biasing force applied to the lever arm. Compression springs 41 are also conventional coil springs composed of steel spring wire which are also linearly increasing in force as they compress throughout the travel distance of the closures from the point of engagement with the lever arm to fully closed position of the closure.

For a fuller understanding of the valve system of the present invention and for design of the mechanical biasing means in accordance therewith for the valve and the related flow system, reference is made to FIG. 11 which is a representative plot of the magnitude of the forces on a lip of valve of the character described tending to open and to close it, throughout the range of positions of the lip from full open to full closure. FIG. 11 depicts both the interrelated forces acting upon the lips of the valve system of this invention when the lips are subject to a constant flow condition, as at the beginning of start-up, and also when the cleaner is in steady-state operation and with the valve lips thus subjected to the full dynamic effects of intermittent flow through the system.

For this plot, force on the lip is taken as the force perpendicular to the flow direction, measured by a force gauge attached to the upstream edge of the lip, required to maintain the lip stationary at the measured location. The closure force generated by water flow is measured with the lip unrestrained by any biasing force. The biasing force is measured in the absence of water flow. The lip position is designated as the distance between the upstream edges of the lips at the measured location as compared to their distance at the fully open position, i.e. as a percentage of the distance at fully open.

It is found that when the lips are thus held stationary, progressively, at positions from full open to fully closed the force created by the water flow tending to close the valve under such steady flow conditions will typically describe the curve extending from A and B. As the valve lips move from static positions from fully open toward full closure the magnitude of the closing force will increase at a greater than lineal rate, i.e. the closing force increases at an increasing rate as the valve moves to full closure. The foregoing force on the lips when they are held stationary with a steady or continuous flow state, for convenience, are referred to as the "steady flow" force.

It has been found, further, that during sustained operation after start-up dynamic conditions come into play that alter the forces on the valve lips from that of the steady flow state. Specifically, during the dynamic conditions of operation the momentum of the water now moving in the closed system of chamber 7 at a substantial velocity, decreases the interior pressure and thus increases the closing force upon the valve lips to a level as illustrated by the curve extending from A to C in FIG. 11 as the valve closes. At full closure this momentum creates a "water hammer" effect as shown at C, with the closure force increasing at a very high rate and then falling off sharply to B as the water rapidly looses velocity to result in a lower closing force. The inertia of the more slowly moving water causes the interior pressure to increase, thus reducing the closing force on the lips down to a lower level as the valve returns to the open position, as illustrated by the curve from D to E, which is also below the steady flow force (curve from B to A).

The region between the curves extending from A to D can be considered as a "dynamic envelope" and the dynamic forces that they portray, along with the forces at steady flow conditions previously described, are to be taken into account in the operation of this invention. Throughout the full cycle of the lips, from open to closure and open again, the opening bias force is to remain within the dynamic envelope. That is, over travel of the lips from fully open to fully closed the opening bias force is to remain below curve A to C, the dynamic closing force, so that a net closing force is maintained to bring the lips fully to closure. Over travel of the lips back from fully closed to fully open the opening bias force is to remain above line D to E so that a net opening force is maintained to bring the lips to the fully open position.

Additionally, for purposes of start-up of the cleaner from an at-rest condition, during which steady flow conditions initially prevail instead of dynamic flow conditions, closure bias force at full open and in an initial region of lip travel towards closure should be substantially below curve A to B so that there is a substantial net closing force to initiate closure. This region of lip travel will be referred to as the closure-initiating region. Desirably, the closure-initiating region extends from the full open position over the first 10% to 40% of lip travel towards closure and preferably up to between 20% to 30% of the lip travel.

In designing appropriate bias conditions towards closure from the closure-initiating region, the steady flow closure force curve A to B can be a convenient guide. Designing the magnitude of closure bias force to closely follow this curve, i.e. to essentially equal the magnitude of the steady flow closure force, will insure that the bias force is maintained within the dynamic envelope throughout the cycle.

An additional consideration in bias force design is the possibility of a stoppage of the valve in mid-cycle or at full closure, e.g. due to fouling by debris, in which the dynamic conditions terminate. Maintaining the magnitude of bias force substantially above the steady flow closure force curve A to B will insure that the lips will resume cycling even after dynamic conditions cease. If there is a substantial net opening force in steady flow conditions (i.e. the opening bias force on the lips is substantially less than the closure force on the lips generated by steady flow conditions), the lips will move back to the full open position even in steady flow conditions. Since at full open there is a net closing force (in the closing-initiating region), full cycling will then resume.

The foregoing relationship is of greater importance at full closure and in the initial region of lip travel towards open (the opening-initiating region) where stoppage would be more likely to occur. Desirably, the opening-initiating region extends from the closed position over at least the first 10% to 40% of lip travel towards the open position.

The dimensions of the dynamic envelope will be a function of the length and diameter of chamber 7 which can be characterized as an "inertial chamber," as it is in this chamber that the inertial forces of dynamic flow are manifested upon closure of the valve. For this purpose chamber 7 should have walls with sufficient rigidity that they do not materially expand or collapse with fluctuating pressure. The smaller the diameter and greater the length, the greater are the dynamic forces and wider the dynamic envelope. If the envelope is wide enough a linear opening bias force may be employed that is above the steady flow closure force curve A to B beyond the closure initiating region and still remain in the dynamic envelope. This design may be preferable for simplicity and convenience of manufacture and operation. Desirably, chamber 7 is at least 10 centimeters in length and the diameter at least 1 centimeter. A length of at least 20 cm and a diameter of at least 1.5 cm is preferred as this will provide a larger dynamic envelope and hence greater flexibility in designing the closure bias.

However, if it is desired to follow more closely the steady flow closure force curve or if the dynamic envelope is too small to accommodate a linear opening bias force then, as a function of the total travel distance of the lips between open and closed, the magnitude of increase of bias force from full open to a point beyond the closure-initiating region should be substantially less than a direct proportion of the total increase of the bias force over the full distance from the full open to the full close position, at least up to the closure-initiating region. This is because both the dynamic envelope and the steady flow closure force tend to increase at a greater than linear rate towards full closure.

The absolute values for the biasing forces from the open to the closed position to be provided by the biasing means will depend upon the size and configuration of the valve and particularly of the valve lips and mouth, the diameter and length of chamber 7 and the flow rate or vacuum pump setting for which the cleaner is to be designed. In practice, once the other indicated parameters have been established and an operational model built, then the appropriate mechanical biasing forces can be designed into the cleaner. This can be done by measuring the flow forces on the valve lips at design flow conditions at a series of positions from fully open to fully closed, as previously described, to arrive at an approximation of the dynamic envelope and the static hydraulic closing force. Appropriate biasing forces from fully open to fully closed position based on this data can then be selected in accordance with the previously indicated criteria and built into the biasing means.

Alternatively, the biasing force design can be arrived at fairly efficiently by an iterative procedure in which the valve lips are preloaded and the cleaner tested in design flow conditions, with adjustment of the loading as needed so that the there is substantial opening force but not quite enough to prevent the lips from moving toward the closed position. Then the bias force is adjusted as needed over the range of movement towards closure so that the bias force is barely overcome to continue lip movement rapidly to full closure.

In either method of biasing force design it is preferable to utilize for test purposes the environment of a typical swimming pool installation, employing a conventional pressure-sensitive diverter valve to establish the desired operating conditions (pressure and flow rate) and a minimum of eight feet of flexible connector hose. After generally satisfactory valve cycling or beating is achieved as described fine adjustments can be made to the biasing system to optimize beating, with a 4 or 5 beats per second usually preferred, and its range of operation from 2 to 8 beats per second.

To achieve an appropriate bias loading for the valve embodiment of FIGS. 7 to 10, the opening force at constant flow conditions at the design flow rate may be determined over a series of lip positions from full open to full close as described previously and the steady flow closing force curve A-B is plotted. Then, the appropriate anchor pin 40 and lever arm anchor hole 38 for tension spring 37 are selected that imparts a bias force on the valve lip that is substantially below line A-B in the closure-initiating region but at the same time closely approximates the curve A-B over the intermediate region. The resulting bias force curve for the tension spring is plotted as curve G-H. Then, compression springs 41 may each be positioned on platform 39 so that they are each engaged by the respective lever arm 35 at the point where the lip reaches the closure-initiating region. Compression springs 41 are selected that will impart an additional closure biasing force on the lip to raise the total biasing force (including that imparted by tension spring 37) in the closure-initiating region to a level substantially above line A-B but, at the same time below curve A-C, the opening force in this region under dynamic flow conditions. The bias force curve resulting from the additive forces of tension spring 37 and compression spring 41 are plotted as curve H-I.

Alternatively, the iterative procedure for designing the bias loading may be carried out for this valve embodiment as follows for each closure 33. With tension spring engaged an anchor hole 38 midway along lever arm 35, a downstream anchor pin 40 is selected for tension spring 37 for an initial test that provides a light closure bias at the open position. After testing the anchor point can be adjusted and the valve retested until the closure force at open is substantial but not quite enough to resist lip motion towards closure. The tension force of tension spring 37 is then measured by a force gauge (e.g. a weight scale) and selected as the magnitude of bias force at the fully open position. The magnitude of the bias force as the lips move towards closure depends both on the strength of the spring and the length of the lever arm (distance of anchor hole 38 from pivot pin 36). Therefore, the valve action is next tested with tension spring 37 engaged at alternative anchor holes 38 along lever arm 35 and at a anchor pin 40 that maintains the tension force on tension spring 37 essentially at the selected force magnitude for the fully open position. The anchor hole 38 selected is the one at which the bias force is highest consistent with rapid closure of the lips. If needed to meet this criteria, a stronger or weaker spring may be substituted.

Next compression spring 41 is set so that it engages lever arm 35 when lip 34 has reached approximately 70% of its travel towards full closure. The position of spring 41 can then be adjusted to vary the position along the length of arm 35 at which spring 41 engages it. In this fashion the additional bias force can be adjusted in test operation such that the lips will still rapidly close but instantly open again.

The appropriate opening bias of lips 17 of the embodiment of FIGS. 2 to 6 may be built into that embodiment by essentially the same iterative procedure described for the coil spring embodiment. In this case the magnitude of biasing force applied is changed by adjusting the stiffness of shank 18. Adjusting the bias is accomplished by increasing or decreasing the effective width of shank 18 and/or shortening or lengthening its length. In this configuration shank imparts a bias force that increases essentially linearly as lip 17 moves from open to closed.

If, instead, it is desired to have the bias increase at a rate that is greater than linear, then the effective length of shanks 18 may be shortened when lips 17 have moved a part of the distance, say 60–70% towards closure at which closures 16 have flexed so that shanks 18 have assumed a bowed configuration. This may be accomplished by positioning a stop 50 (shown in phantom lines in FIG. 5) along each shank 18 at a distance upstream from end section 20 and outwardly of wall 15 a distance such that shank 18 lodges against the stop to prevent further upward "bowing" movement upstream of the stop when the lip has reached a position around 60–70% of its travel towards closure.

However, it is found that with an inertial chamber of one inch (2.54 cm) in diameter and 16 inches (40.6 cm) in length the dynamic envelope may be sufficiently large that a bias that simply increases linearly can provide a bias force configuration for the valve embodiment of FIGS. 2–6 that fulfills the requirements of this invention detailed previously. FIG. 12 shows an approximation of the dynamic envelope and bias force configuration for this embodiment.

Instead of two cooperating lips, valves in accordance with this invention may utilize a single lip that pivots across the entire valve mouth to close against a stationary lip or dam. Alternatively multiple lips, e.g. 3 or 4, of triangular shape may be employed. In this configuration the triangular walls would be sized so that their tips and side margins meet upon closure to completely close the mouth.

For valve embodiments employing a single or two cooperating lips, such lips are preferably rectangular with their upstream edges straight and perpendicular to the axis of pivot of the lip. Optionally, however, they may have an elastomeric tip section. The elastomeric tip section will tend to conform around any debris caught between the lips as they close to help insure full closure. This will help to prevent the lips from becoming stuck at a partially closed position. Flow continuing around the debris may possibly disrupt the dynamic flow conditions such that closure force predominates to maintain the lips stuck at the partially closed position. This tip section may be quite short, e.g. 10% of the lip length, so that any creep on extended operation will not materially effect valve operation. Also optionally, the upstream edges of the lips may be angled to project a short distance toward the center of the mouth to thereby increase the closing force on the lips generated by water flow.

Other low-creep biasing arrangements may be employed, as will be apparent to those skilled in the art for achieving the necessary bias force pattern over closure. Biasing means may be applied directly or indirectly to one or both lips urging them apart, e.g. by a tension coil spring directly to the lip that is properly mounted to urge the lip outward.

For the bias any low creep elastic materials can be utilized, preferably metal such as spring steel, and typically materials with a strain at their elastic limit (increase in length over original length in the relaxed state) of below 0.5. Elastic materials with a strain at the elastic limit of less than 0.2 are desirable and those below 0.1 are preferred. With a few exceptions, such as fiber reinforced polyester, most elastic plastic materials have high creep properties and are therefore unsuitable. Aside from the deformable lip edges described, preferably the lips, mouth and other portions of the valve are constructed of low creep material as well.

Provision of a funnel section in advance of the mouth of the valve which narrows to a cross-section substantially equal to that of the valve mouth channels debris in the flow directly into the mouth. This facilitates flow of debris through the valve and minimizes fouling of the lips In accordance with this invention and based on the foregoing, a reliable sweep valve may be constructed with a low creep bias, thus avoiding the shortcomings of an elastomeric valve.

We claim:

1. A swimming pool cleaner comprising a cleaning head having a passage extending therethrough from an inlet, which in use engages the surface to be cleaned, to an outlet for connection to a flexible suction hose having a flow system comprising a valve within the passage at the upstream end of a rigid-walled inertial chamber forming a section of the passage, the valve having:

a. a mouth comprising at least one lip, said lip being movable independently of the walls of said chamber downstream thereof in response to water flow therethrough from an open position of the mouth permitting flow into said section to a closed position of the mouth to shut off flow into said section and b. biasing means with low creep characteristics, for urging the lip to the open position, said biasing means imparting an opening force to the lip i. throughout the range of movement of the lip between open and close under dynamic flow conditions at the design flow rate that is substantially less than the closing force created by the water flow through the valve mouth urging the lip movement towards closure and substantially greater than the closing force imparted by flow through the mouth during lip travel from full closure to the open position and ii. over an initial closure-initiating region beginning from the fully open position an opening force on the lip that is substantially less than the closing force on the lip created by the water flow through the valve mouth under steady flow conditions at the design flow rate.

2. A swimming pool cleaner as in claim 1 and wherein said biasing means provides a progressively greater opening bias force over the range of lip movement from the open position to full closure and imparts throughout the range of movement of the lip over an opening-initiating region towards open beginning from the full closed position, an opening force on the lip that is substantially greater than the closing force on the lips created by water flow through the mouth under steady state flow conditions at the design flow rate.

3. A swimming pool cleaner as in claim 1 and wherein said biasing means imparts throughout the range of movement of the lip towards closure after the closure-initiating region an opening force on the lip that is substantially greater than the closing force on the lips created by water flow through the mouth under steady state flow conditions at the design flow rate.

4. A swimming pool cleaner as in claim 1 and wherein said biasing means provides a progressively greater opening bias force over the range of lip movement from the open position to towards full closure.

5. A swimming pool cleaner as in claim 4 and wherein said biasing force increases at a rate between the open position and full closure that is at least linear.

6. A swimming pool cleaner as in claim 5 and wherein said biasing force increases at a rate between the open position and full closure that is greater than linear.

7. A swimming pool cleaner as in claim 1 and wherein said biasing means comprises a resilient material having a strain at its elastic limit of below 0.5.

8. A swimming pool cleaner as in claim 7 and wherein said biasing means comprises a spring metal.

9. A swimming pool cleaner as in claim 1 and wherein said biasing means comprises at least one metal spring urging said lip towards open.

10. A swimming pool cleaner as in claim 9 and wherein said lip has a pivot about which said lip moves between the open and closed position and said spring, biasing means further comprises a lever arm attached to said lip and said spring is positioned to urge said lever arm in a direction to move said lip toward the open position.

11. A swimming pool cleaner as in claim 10 and wherein said spring is a coil spring connected to said lever arm under tension.

12. A swimming pool cleaner as in claim 11 and wherein said biasing means further includes a second spring positioned to urge said lever arm in a direction to move said lip towards the open position over the region of lip movement extending from full closure up to 40% of the distance toward the open position, whereby to provide an additional opening bias force over said region extending from full closure.

13. A swimming pool cleaner as in claim 12 and wherein said second spring is a coil spring positioned to compressively engage said lever arm over the region of lip movement extending from the full closure up to 40% of the distance toward the open position.

14. A swimming pool cleaner as in claim 1 and wherein said rigid-walled inertial chamber is generally cylindrical and is at least 10 cm in length and at least 1 cm in diameter.

15. A swimming pool cleaner as in claim 14 and wherein said rigid-walled inertial chamber is at least 20 cm in length and at least 1.5 cm in diameter.

16. A swimming pool cleaner comprising a cleaning head having a passage extending therethrough from an inlet, which in use engages the surface to be cleaned, to an outlet for connection to a flexible suction hose having a flow system comprising a valve within the passage at the upstream end of a rigid-walled chamber forming a section of the passage, the valve having:

a. a passage therethrough forming a mouth, said mouth having a closure means comprising at least one lip, said lip extending upstream from a pivot axis along said passage and being movable about said pivot axis independently of the walls of said chamber downstream thereof in response to water flow therethrough from an open position of the mouth permitting flow into said section to a closed position of the mouth to close said valve passage to thereby shut off flow into said section and b. biasing means with low creep characteristics for urging the lip to the open position, said biasing means imparting an opening force to the lip i. throughout the range of movement of the lip between open and close under dynamic flow conditions at the design flow rate that is substantially less than the closing force created by the water flow through the valve mouth urging the lip movement towards closure and substantially greater than the closing force imparted by flow through the mouth during lip travel from full closure to the open position and ii. over an initial closure-initiating region beginning from the fully open position an opening force on the lip that is substantially less than the closing force on the lip created by the water flow through the valve mouth under steady flow conditions at the design flow rate.

17. A swimming pool cleaner as in claim 16 and wherein said lip extends generally in the valve passage direction when in the open position.

18. A swimming pool cleaner as in claim 17 and wherein said closure means comprises an opposed pair of said lips with the upstream edges said of lips meeting in the middle of said valve passage when in the closed position whereby to close off said valve passage.

19. A swimming pool cleaner as in claim 16 and wherein said biasing means comprises a resilient material having a strain at elastic limit of below 0.5.

20. A swimming pool cleaner as in claim 19 wherein said rigid-walled inertial chamber is generally cylindrical and is at least 20 cm in length and at least 1.5 cm in diameter.

21. A swimming pool cleaner as in claim 16 and wherein said cleaner head passage further comprises a funnel section upstream of and confronting said valve mouth said funnel section narrowing in the downstream direction from a larger cross-section to a smaller cross-section that is substantially equal to that of the valve mouth, whereby to channel debris directly into the mouth.

22. A pool cleaner as in claim 1 and wherein upstream of said valve said passage comprises a unitary flow path to said valve.

23. A pool cleaner as in claim 16 and wherein upstream of said valve said passage comprises a unitary flow path to said valve.

24. A swimming pool cleaner comprising a cleaning head having a passage extending therethrough from an inlet, which in use engages the surface to be cleaned, to an outlet for connection to a flexible suction hose having a flow system comprising a valve within the passage at the upstream end of a rigid-walled chamber forming a section of the passage, the valve having:

a. a passage therethrough forming a mouth, said mouth having a closure means comprising at least one lip, said lip extending upstream from a pivot axis along said passage and being movable about said pivot axis independently of the walls of said chamber downstream thereof in response to water flow therethrough from an open position of the mouth permitting flow into said section to a closed position of the mouth to close said valve passage to thereby shut off flow into said section and b. biasing means with low creep characteristics for urging the lip to the open position comprising a low creep resilient lever arm attached to said lip and acting on said lip about said pivot axis, said lever arm being restrained at a position along the lever arm distant from the pivot axis from rotation about said axis, said biasing means imparting an opening force to the lip i. throughout the range of movement of the lip between open and close under dynamic flow conditions at the design flow rate that is substantially less than the closing force created by the water flow through the valve mouth urging the lip movement towards closure and substantially greater than the closing force imparted by flow through the mouth during lip travel from full closure to the open position and ii. over an initial closure-initiating region beginning from the fully open position an opening force on the lip that is substantially less than the closing force on the lip created by the water flow through the valve mouth under steady flow conditions at the design flow rate.

25. A swimming pool cleaner as in claim 24 and wherein said lever arm comprises a leaf spring integral with said lip.

26. A swimming pool cleaner as in claim 25 and wherein said closure means comprises an opposed pair of said lips with the upstream edges said of lips meeting in the middle of said valve passage when in the closed position whereby to close off said valve passage.

27. A swimming pool cleaner as in claim 25 and wherein said biasing means provides a progressively greater opening bias force over the range of lip movement from the open position to towards full closure.

28. A swimming pool cleaner as in claim 25 wherein said biasing means imparts throughout the range of movement of the lip over an opening-initiating region towards open beginning from the full closed position, an opening force on the lip that is substantially greater than the closing force on the lips created by water flow through the mouth under steady state flow conditions at the design flow rate.

29. A swimming pool cleaner as in claim 25 and wherein said biasing means imparts throughout the range of movement of the lip towards closure after the closure-initiating region an opening force on the lip that is substantially greater than the closing force on the lips created by water flow through the mouth under steady state flow conditions at the design flow rate.

* * * * *